US007182637B2

(12) United States Patent
Coyle, Jr. et al.

(10) Patent No.: US 7,182,637 B2
(45) Date of Patent: Feb. 27, 2007

(54) CONNECTORS FOR UNDER CABINET LIGHTING

(75) Inventors: William J. Coyle, Jr., Toms River, NJ (US); Joseph G. Lares, Barnegat, NJ (US); Robert H. Smith, Port Murray, NJ (US)

(73) Assignee: Heyco, Inc., Toms River, NJ (US)

( * ) Notice: Subject to any disclaimer, the term of this patent is extended or adjusted under 35 U.S.C. 154(b) by 0 days.

(21) Appl. No.: 10/516,192

(22) PCT Filed: May 28, 2003

(86) PCT No.: PCT/US03/16715

§ 371 (c)(1),
(2), (4) Date: Sep. 28, 2005

(87) PCT Pub. No.: WO03/103104

PCT Pub. Date: Dec. 11, 2003

(65) Prior Publication Data

US 2006/0099841 A1 May 11, 2006

Related U.S. Application Data

(60) Provisional application No. 60/384,345, filed on May 30, 2002.

(51) Int. Cl.
*H01R 13/73* (2006.01)
*H02B 1/01* (2006.01)

(52) U.S. Cl. ..... 439/557; 439/682; 439/281

(58) Field of Classification Search ..... 439/557, 439/682, 281, 248, 544
See application file for complete search history.

(56) References Cited

U.S. PATENT DOCUMENTS 1,480,295 A 1/1924 O'Connor (Continued)

FOREIGN PATENT DOCUMENTS

DE 440 555 2/1927

(Continued)

*Primary Examiner*—Javaid H. Nasri
(74) *Attorney, Agent, or Firm*—McCarter & English, LLP

(57) ABSTRACT

A panel-mounted electrical connector pair (12,36) has a recessed electrical connector (12) having a socket portion (18) with a first flange (26) proximate an open end (20) thereof, a first distal web (22) and a first type of electrical terminal (24*a*) protruding through said first distal web (22). The socket portion (18) is extendable through a first opening (64) in a first panel (62), with the first flange (26) abutting against the first panel (62). The connector pair (12, 36) includes a protruding connector (36) with a plug portion (38). The protruding connector (36) has a proximal end plate (42), a second distal web (44) spaced from the proximal end plate (42), a second flange (48) disposed on the protruding connector (36) proximate to the second distal web (44), and a second type of electrical terminal (46*a*) protruding through the second distal web (44) toward the proximal end plate (42). The proximal end plate (42) has an opening (94*a*) therein aligned with the second type of electrical terminal (46*a*). The protruding connector (36) is extendable through a second opening (76) in a second panel (74), with the second flange (48) abutting against the second panel (74). The plug portion (38) is slideably receivable within the socket portion (18) with the proximal end plate (42) approaching the first distal web (22). The first type electrical terminal (24*a*) penetrates the opening (94*a*) in the end plate (42) and electrically contacts the second type electrical terminal (46*a*) establishing an area of contact located between the first flange (26) and the first distal web (22) when the first panel (62) and the second panel (74) are brought together in close parallel juxtaposition.

17 Claims, 7 Drawing Sheets

U.S. PATENT DOCUMENTS

| | | | |
|---|---|---|---|
| 1,817,543 | A | 8/1931 | Ciraolo |
| 2,109,341 | A | 2/1938 | Rebl |
| 2,175,155 | A | 10/1939 | Miller et al. |
| 2,238,589 | A | 4/1941 | Hensler |
| 2,344,935 | A | 3/1944 | Whittaker |
| 2,401,555 | A | 6/1946 | De Reamer |
| 2,988,633 | A | 6/1961 | Rosenfield |
| 3,002,175 | A | 9/1961 | Bertram et al. |
| 3,070,689 | A | 12/1962 | McIntosh |
| 3,091,748 | A | 5/1963 | Takes et al. |
| 3,094,364 | A | 6/1963 | Lingg |
| 3,265,886 | A | 8/1966 | Wigert |
| 3,289,145 | A | 11/1966 | Ruehlemann et al. |
| 3,377,488 | A | 4/1968 | Lorenzo |
| 3,428,799 | A | 2/1969 | Bassani |
| 3,504,169 | A | 3/1970 | Freeburger |
| 3,514,590 | A | 5/1970 | Shaeffer |
| 3,524,050 | A | 8/1970 | Gustine |
| 3,560,908 | A | 2/1971 | Dell et al. |
| 3,564,234 | A | 2/1971 | Phlieger, Jr. |
| 3,569,909 | A | 3/1971 | Garver |
| 3,594,696 | A | 7/1971 | Witek, Jr. |
| 3,619,602 | A | 11/1971 | Wilde |
| 3,633,023 | A | 1/1972 | Castiglioni et al. |
| 3,824,524 | A | 7/1974 | Glover |
| 3,986,765 | A | 10/1976 | Shaffer et al. |
| 3,989,343 | A | 11/1976 | Lucius et al. |
| 4,001,571 | A | 1/1977 | Martin |
| 4,092,562 | A | 5/1978 | Campbell |
| 4,130,860 | A | 12/1978 | Careglio et al. |
| 4,607,317 | A | 8/1986 | Lin |
| 4,639,841 | A | 1/1987 | Salestrom et al. |
| 4,726,781 | A | 2/1988 | Bernhart et al. |
| 4,820,180 | A | 4/1989 | Mosquera et al. |
| 4,832,613 | A | 5/1989 | Tsukakoshi |
| 4,866,583 | A | 9/1989 | Targetti |
| 4,895,535 | A | 1/1990 | Emadi et al. |
| 4,907,138 | A | 3/1990 | Brueggemann et al. |
| 4,915,641 | A | 4/1990 | Miskin et al. |
| 5,002,497 | A | 3/1991 | Plocek et al. |
| 5,017,151 | A | 5/1991 | Peterson |
| 5,044,971 | A | 9/1991 | Hollingsworth |
| 5,046,956 | A | 9/1991 | Takano |
| 5,113,328 | A | 5/1992 | Foster et al. |
| 5,161,882 | A | 11/1992 | Garrett |
| 5,226,724 | A | 7/1993 | Kanarek |
| 5,249,982 | A | 10/1993 | Funck et al. |
| 5,260,678 | A | 11/1993 | Van Wagener et al. |
| 5,422,800 | A | 6/1995 | Entrop et al. |
| 5,436,816 | A | 7/1995 | Nagano |
| 5,445,552 | A | 8/1995 | Hine |
| 5,493,482 | A | 2/1996 | Bowen |
| 5,521,805 | A | 5/1996 | Lim |
| 5,525,074 | A | 6/1996 | Tsuji et al. |
| 5,595,432 | A | 1/1997 | Vanderhoof |
| 5,628,557 | A | 5/1997 | Huang |
| 5,641,294 | A | 6/1997 | Beard |
| 5,658,067 | A | 8/1997 | Engle et al. |
| 5,702,176 | A | 12/1997 | Engle |
| 5,751,117 | A | 5/1998 | Abbott |
| 5,779,500 | A | 7/1998 | Tokuwa et al. |
| 5,895,290 | A | 4/1999 | Self, Jr. |
| 5,964,518 | A | 10/1999 | Shen |
| 5,984,721 | A | 11/1999 | Self, Jr. et al. |
| 6,017,233 | A | 1/2000 | Fry et al. |
| 6,109,960 | A | 8/2000 | Cooper et al. |
| 6,113,248 | A | 9/2000 | Mistopoulos et al. |
| D440,692 | S | 4/2001 | Janos et al. |
| 6,299,327 | B1 | 10/2001 | Camarota |

FOREIGN PATENT DOCUMENTS

| | | |
|---|---|---|
| DE | 30 42 293 A1 | 5/1982 |
| EP | 0 330 497 A1 | 8/1989 |
| JP | 1274369 | 11/1989 |

CONNECTORS FOR UNDER CABINET LIGHTING

CROSS REFERENCE TO RELATED APPLICATIONS

This application is 371 of PCT/US03/16715 filed May 28, 2003, which claims priority to U.S. provisional patent application Ser. No. 60/384,345, filed May 30, 2002.

TECHNICAL FIELD OF THE INVENTION

The present invention relates to the field of electrical connectors, in particular, to devices for establishing electrical connections between modular electrical fixtures.

BACKGROUND ART

Modular lighting fixtures presently are known wherein a number of similar fixtures may be provided and installed end-to-end. These structures typically are hard-wired to each other and to a source of electrical current, which is a time-consuming process often requiring the services of a licensed electrician. Mated electrical connectors have been proposed for electrically bridging adjacent lighting units without the need for wired connections between the units. It remains an objective, however, to provide an electrical connection device that allows a plurality of fixtures to be electrically connected each to the next in an end-to-end arrangement in a maximally safe, economical, convenient and reliable manner. The device should be simple enough so that it can be installed and connected by relatively unskilled persons at the site. The device should also be simple in design to facilitate manufacturing and promote its interchangeability among fixtures presently on the market.

DISCLOSURE OF THE INVENTION

The problems and disadvantages associated with conventional apparatus and methods for connecting lighting fixtures are addressed by the present invention which includes a panel-mounted electrical connector pair having a recessed electrical connector with a housing body. The housing body has a socket portion with a first flange proximate an open end thereof, a first distal web and at least one first type of electrical terminal protruding through the first distal web. One end of the at least one first type electrical terminal extends into the socket portion, with another end thereof protruding through the distal web in a direction opposite to the socket portion. The socket portion is extendable through a first opening in a first panel, with the first flange abutting against a first surface on the first panel. The connector pair includes a protruding connector with a plug portion. The protruding connector has a proximal end plate, a second distal web spaced from the proximal end plate, a side wall extending between the proximal end plate and the second distal web, a second flange disposed on the protruding connector proximate to the second distal web and at least one second type of electrical terminal protruding through the second distal web toward the proximal end plate. The proximal end plate has at least one opening therein aligned with the at least one second type of electrical terminal. The protruding connector is extendable through a second opening in a second panel, with the second flange abutting against a second surface on the second panel. The plug portion is slideably receivable within the socket portion with the proximal end plate approaching the first distal web. The at least one first type electrical terminal penetrates the at least one opening in the end plate and electrically contacts the at least one second type electrical terminal establishing an area of contact located between the first flange and the first distal web when the panel and the second panel are brought together in close parallel juxtaposition.

BRIEF DESCRIPTION OF THE DRAWINGS

For a more complete understanding of the present invention, reference is made to the following detailed description of the exemplary embodiments considered in conjunction with the accompanying drawings, in which.

BEST MODE FOR CARRYING OUT THE INVENTION

Throughout the present disclosure, the terms "proximal", "proximate", "distal" and "distant" are defined relative to the end of each connector that faces or contacts its mated connector.

Figure 1:
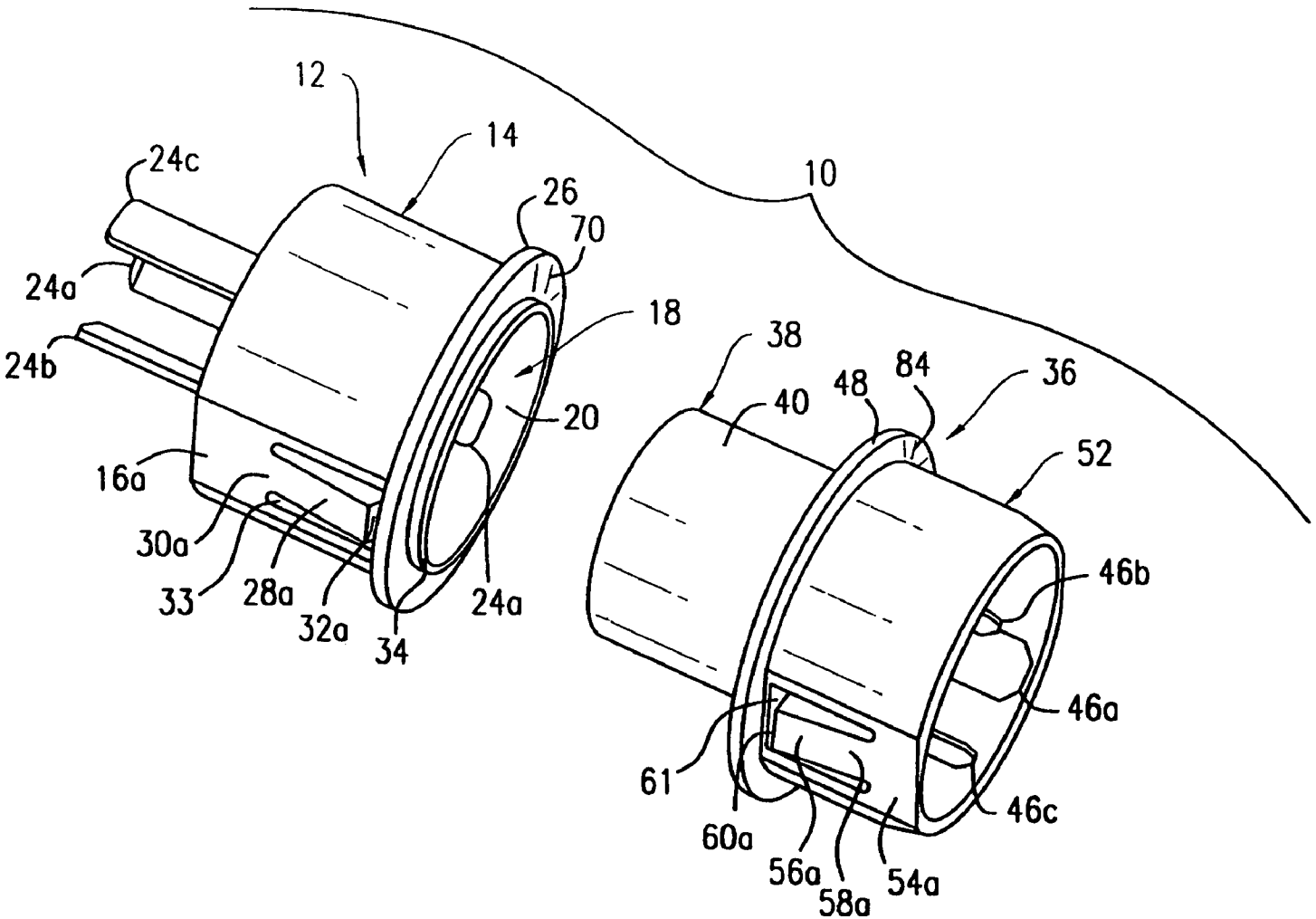
FIG. 1 is a perspective view of a mated electrical connector pair according to the present invention with the connectors separated from each other.
Figure 2:
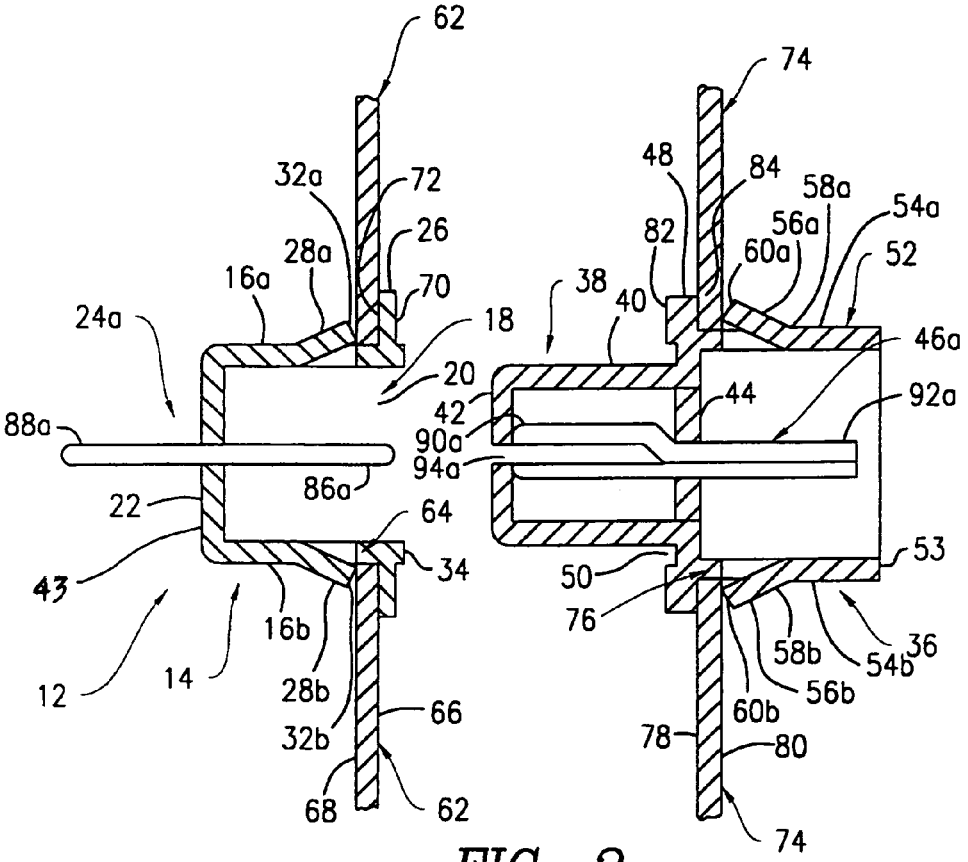
FIG. 2 is a schematic cross-section of the mated electrical connector pair of FIG. 1 with the connectors separated from each other.
Figure 3:
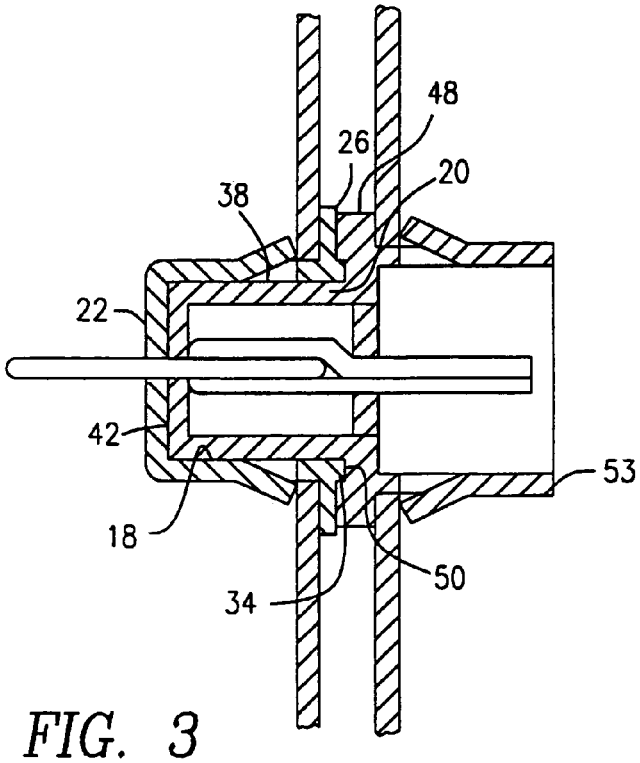
FIG. 3 is a schematic cross-section of the mated electrical connector pair of FIG. 1 with the connectors joined to each other.

FIGS. 1–3 illustrate a preferred embodiment of a mated electrical connector pair 10 according to the present invention. Recessed connector 12 has a substantially cylindrical housing body 14 having flats 16*a*, 16*b* on opposite sides of its exterior surface and a socket 18 having a proximal open end 20 and a distal web 22 (FIG. 2). Web 22 retains a plurality of male electrical terminals 24*a*,24*b*,24*c*, which project into the interior of socket 18 and are recessed behind its open end 20. A flange 26 is located near the open end 20 of socket 18 and is continuous with the exterior of housing body 14. Retainers 28*a*,28*b* are located within flats 16*a*,16*b*, respectively, and have fixed ends 30*a*,30*b* which are integral with housing body 14, and free ends 32*a*,32*b* which are adjacent to the distal side of flange 26 and protrude above the surface of flats 16*a*,16*b*, respectively. Retainers 28*a*,28*b* are defined by U-shaped grooves 33 which penetrate flats 16*a*,16*b*. An annular ring 34 is located at the proximal side of flange 26.

Protruding connector 36 has a protruding plug portion 38 with side wall 40, a proximal end plate 42 and a distal web 44 (FIG. 2). Web 44 retains a plurality of female electrical terminals 46*a*,46*b*,46*c* which project interiorly to side wall 40 and are recessed behind end plate 42. A flange 48 is located distally on plug 38 and is continuous with the exterior of the side wall 40. Annular groove 50 is located in the proximal side of flange 48. Cylindrical shroud 52 extends distally from flange 48 and has flats 54*a*,54*b* on opposite sides of its exterior surface. Retainers 56*a*,56*b* are located within flats 54*a*,54*b*, respectively, and have fixed ends 58*a*,58*b* which are integral with shroud 52, and free ends 60*a*,60*b* which are adjacent to the distal side of flange 48 and protrude above flats 54*a*,54*b*. Retainers 56*a*,56*b* are defined by U-shaped grooves 61 which penetrate flats 54*a*, 54*b*.

Only one male electrical terminal 24*a* and one female electrical terminal 46*a* are shown in FIGS. 2 and 3 for ease of illustration. In practice, connectors 12,36 would typically be provided with three terminals each, viz., positive (+), negative (−) and ground (0).

Plug 38 is dimensioned to fit within socket 18, preferably forming a close fit (FIG. 3) between plug 38 and socket 18 along at least a portion of the length of the plug. Plug 38 may be rounded or tapered slightly at the conjunction of end plate 42 and side wall 40 to help guide entry of plug 38 into open end 20 of socket 18. In the illustrated preferred embodiment, socket 18 and plug 38 present circular cross-sections. In other preferred embodiments, the socket 18 and plug 38 may present complementary non-circular cross-sections. Annular ring 34 and annular groove 50 are complementary structures, arranged so that ring 34 fits into groove 50 when plug 38 has been fully inserted within socket 18 (FIG. 3). In other preferred embodiments, annular ring 34 and annular groove 50 may be omitted or other complementary structures may be provided in lieu of the ring and groove.

In the illustrated preferred embodiment, means are not provided to secure the connectors 12 and 36 to each other. It is anticipated that such means would not be needed when the connectors are used to provide an electrical connection between adjacent electrical fixtures, such as fluorescent lighting units, since such units would be secured in place, e.g., to a ceiling or to a cabinet. Connectors 12,36 may be provided with means to secure the joined connectors to each other without departing from the scope of the invention. Such means may include various arrangements of plugs, flanges, or hooks and their receptacles that would be obvious to the ordinarily-skilled practitioner.

Figure 4:
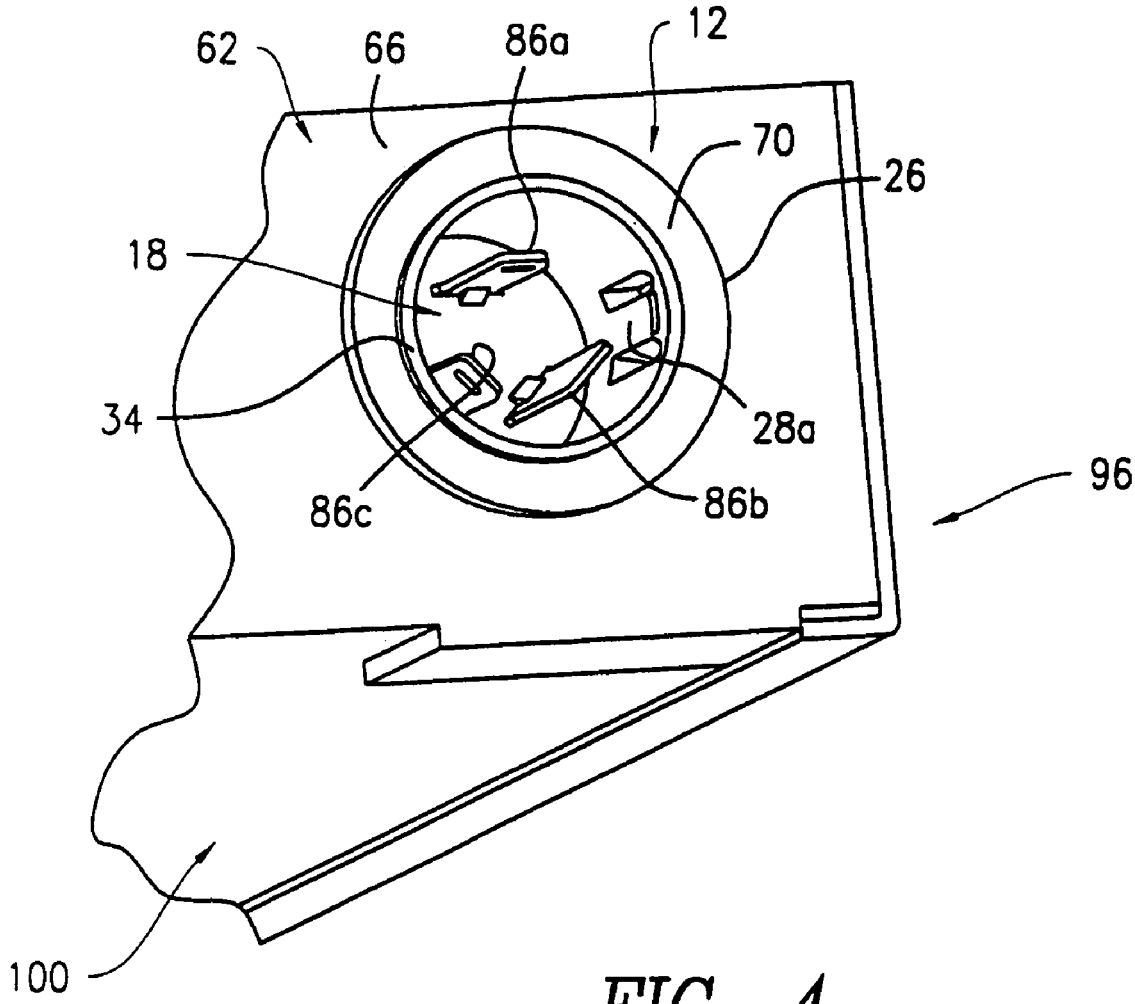
FIG. 4 is a perspective view of the proximal end of a recessed connector according to the present invention as installed in a lighting fixture.

Flange 26 and retainers 28*a*,28*b* co-operate to secure recessed connector 12 within opening 64 of a panel 62 having a proximal side 66 and a distal side 68. Flange 26 presents a proximal face 70 and a distal face 72. Preferably, both faces 70,72 are substantially flat and perpendicular to the outer surface of housing body 14. Flange 26 and retainers 28*a*,28*b* are positioned so that panel 62 is secured between distal face 72 of flange 26 and free ends 32*a*,32*b* of retainers 28*a*,28*b* when connector 12 is installed in opening 64. In the illustrated preferred embodiment, flange 26 is placed near the open end 20 of socket 18 so that only flange 26 and annular ring 34 extend beyond proximal side 66 of panel 62 (FIG. 4). In other preferred embodiments, flange 26 may be located at some distance from open end 20 of socket 18 so that some portion of housing body 14 extends proximally beyond flange 26, and, thus, beyond proximal side 66, so that housing body 14 may act as a spacer between adjacent lighting units.

Figure 6:
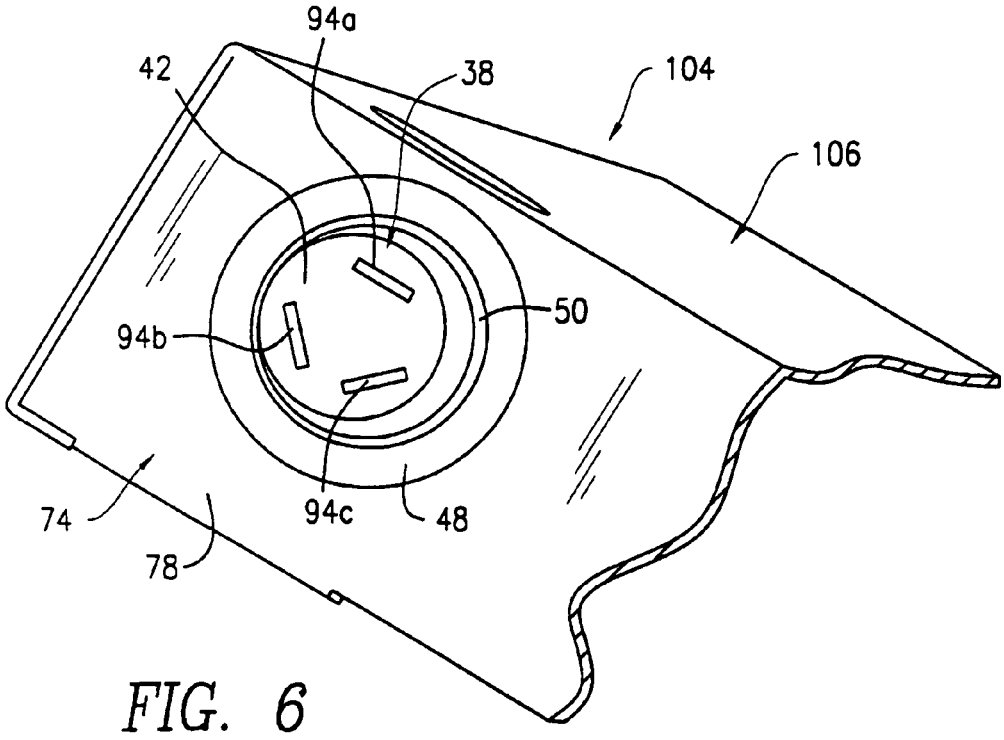
FIG. 6 is a perspective view of the proximal end of a protruding connector according to the present invention as installed in a lighting fixture.

Similarly to the arrangement that secures connector 12, flange 48 and retainers 56*a*,56*b* co-operate to secure protruding connector 36 within opening 76 of a panel 74 having a proximal side 78 and a distal side 80. Flange 48 presents a proximal face 82 and a distal face 84. Preferably, both faces 82,84 are substantially flat and perpendicular to the outer surface of side wall 40. Flange 48 and retainers 56*a*,56*b* are positioned so that panel 74 is secured between distal face 84 of flange 48 and free ends 60*a*,60*b* of retainers 56*a*,56*b* when connector 36 is installed through opening 76. Preferably, when connector 36 is installed within opening 76, only plug 38 and flange 48 project beyond proximal side 78 of panel 74 (FIG. 6). The length of the projecting portion of plug 38 approximates the depth of socket 18 so that the proximal faces 70,82 of flanges 26,48 approach or contact each other when plug 38 is fully inserted into socket 18 (FIG. 3).

Openings 64 and 76 are dimensioned to receive connectors 12 and 36, respectively. In the illustrated preferred embodiment, housing body 14 is provided with flats 16*a*, 16*b*, causing housing body 14 to have a non-circular cross-section perpendicular to its central axis. Similarly, shroud 52 is provided with flats 54*a*,54*b*, causing shroud 52 to have a non-circular cross-section. Preferably, panel openings 64 and 76 have complementary shapes to the non-circular cross-sections of housing body 14 and shroud 52, respectively. This arrangement controls the orientation of connectors 12,36 when they are installed in openings 64,76 and prevents connectors 12,36 from rotating in openings 64,76 after installation. Openings 64,76 may be identical industry-standard panel openings and the respective cross-sections of housing body 14 and shroud 52 may be dimensioned to be complementary to such panel openings. The use of such standard shapes facilitates the mass production of connectors 12,36 and their interchange among pre-fabricated panels and fixtures from various sources. In other preferred embodiments, opening 64 may be of a different size than opening 76 with housing body 14 and shroud 52 dimensioned accordingly. Providing differently-sized openings 64,76 in the opposing end panels of a plurality of lighting fixtures would then force the alternation of recessed connectors and protruding connectors when the lighting fixtures are installed in an end-to-end arrangement.

It is intended that connectors 12,36 of the illustrated preferred embodiment will be installed in their respective panels 62,74 by inserting connectors 12,36 through the corresponding panel openings 64,76. The distal end 43,53 of each connector 12,36 is inserted into the corresponding panel openings 64,76 and the connector is pushed through the opening until distal faces 72,84 of flanges 26,48 each contact proximal sides 66,78 of the corresponding panels 62,74. As the housing body 14 or shroud 52 is inserted through the corresponding panel opening 64,76, the free ends 32*a*,32*b*,60*a*,60*b* of the corresponding retainers 28*a*, 28*b*,56*a*,56*b* are compressed inward toward housing body 14 or shroud 52, respectively. After retainers 28*a*,28*b*,56*a*, 56*b* have been pushed past the panels 62,74, they spring back to their original positions with free ends 32*a*,32*b*,60*a*, 60*b* abutting distal sides 68,80 of panels 62,74, respectively. Preferably, the illustrated combinations of flanges 26,48 and retainers 28*a*,28*b*,56*a*,56*b* are arranged so that free ends 32*a*,32*b*,60*a*,60*b* are released when the corresponding flange 26,48 is in contact with the corresponding panel 62,74, causing the panels 62,74 to become secured between the flanges 26,48 and the free ends 32*a*,32*b*,60*a*,60*b* of retainers 28*a*,28*b*,56*a*,56*b*. This arrangement allows connectors 12,36 to be installed in the field quickly by persons having no special skill and prevents connectors 12,36 from being pulled through openings 64,76 after they have been installed.

Connectors 12,36 may be secured within their respective panels 62,74 by means other than the flange-and-retainer arrangement described herein. For example, they may be secured by the use of adhesives, threaded fasteners, or flanged posts that fit through small holes in the panel.

Connectors 12,36 preferably are fabricated entirely from an insulating material, such as an injection-molded plastic, with the exception of the electrical terminals, e.g., terminals 24*a* and 46*a*, which are fabricated from a metal or metallic alloy suitable for electrical service. Preferably, all of the non-metallic structures recited for the respective connectors 12,36 are fabricated as a single (monolithic) piece.

Recessed connector 12 is provided with three male terminals 24*a*,24*b*,24*c*, each having a corresponding proximal end 86*a*,86*b*,86*c* and distal end 88*a*,88*b*,88*c*. Male terminals 24*a*,24*b*,24*c* pass through web 22 and are retained therein by means known in the art. Distal ends 88*a*,88*b*,88*c* of male terminals 24*a*,24*b*,24*c* project distally beyond web 22. Proximal ends 86*a*,86*b*,86*c* extend toward open end 20 and are recessed within socket 18 so that no part of any proximal end 86*a*,86*b*,86*c* projects beyond open end 20. In the illustrated preferred embodiment, proximal ends 86*a*,86*b*,86*c* are configured as flat blades. In other preferred embodiments, they may be configured as pins or as the male members of other known mated conductor pairs used in electrical connectors.

Protruding connector 36 is provided with three female terminals 46*a*,46*b*,46*c*, each with a corresponding proximal end 90*a*,90*b*,90*c* (only proximal end 90*a* being visible in FIGS. 2 and 3) and distal end 92*a*,92*b*,92*c*. Female terminals 46*a*,46*b*,46*c* pass through web 44 and are retained therein by means known in the art. Proximal ends 90*a*,90*b*,90*c* are located within side wall 40, behind proximal end plate 42. Distal ends 92*a*,92*b*,92*c* project beyond web 44 in a direction away from end plate 42.

Proximal ends 90*a*,90*b*,90*c* of female terminals 46*a*,46*b*,46*c* are accessible to male terminals 24*a*,24*b*,24*c* through openings 94*a*,94*b*,94*c* in end plate 42 of plug 38. As will be evident to the ordinarily-skilled practitioner, openings 94*a*,94*b*,94*c*, female terminals 46*a*,46*b*,46*c* and male terminals 24*a*,24*b*,24*c* must be arranged so that each male terminal will make electrical contact with one female terminal when plug 38 is inserted into socket 18, the connectors 12,36 being properly oriented with respect to each other.

Figure 5:
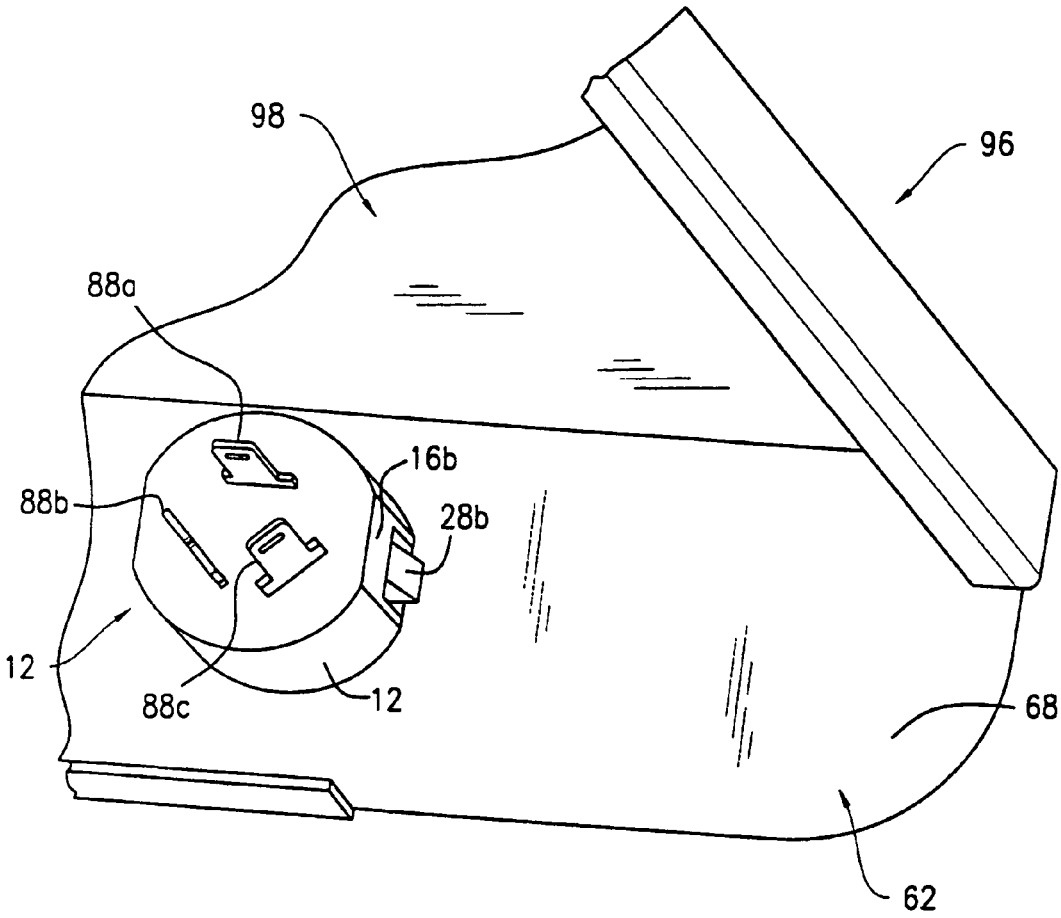
FIG. 5 is a perspective view of the distal end of the recessed connector of FIG. 4 as viewed from beneath the lighting fixture.
Figure 7:
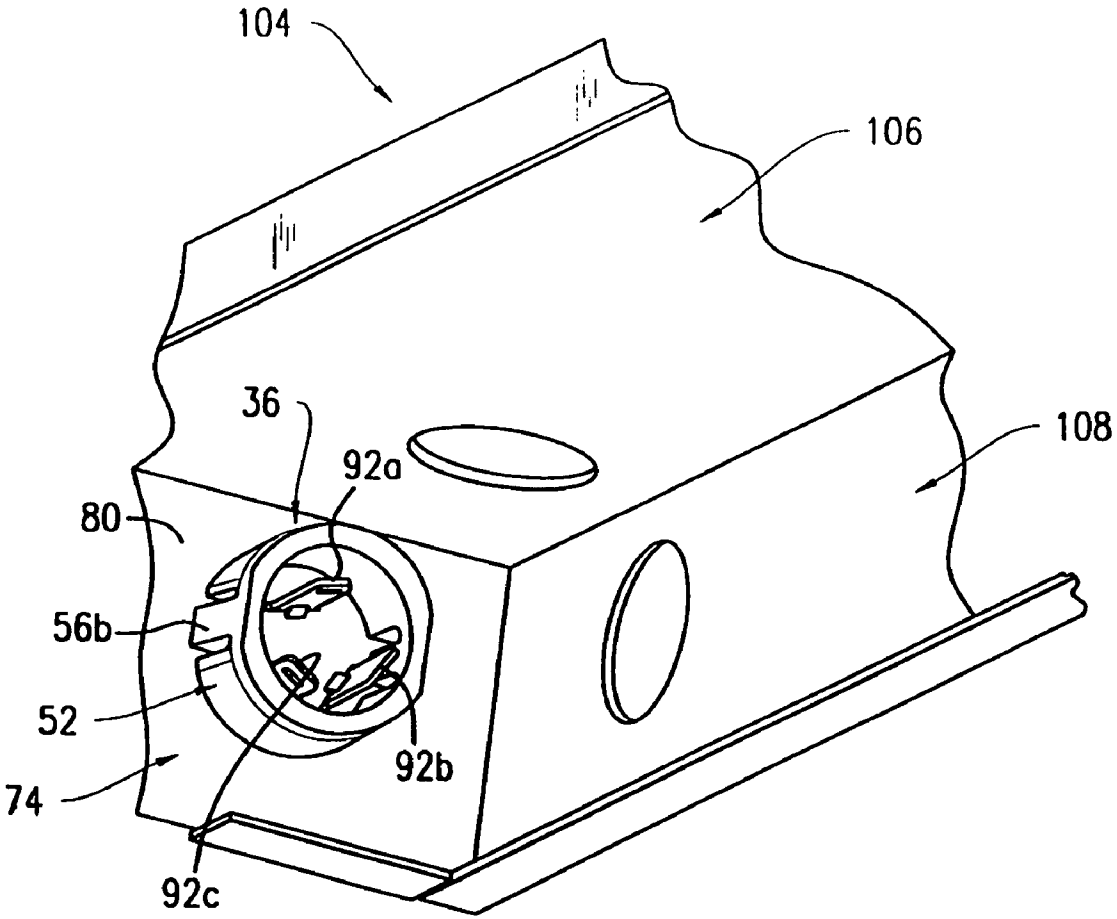
FIG. 7 is a perspective view of the distal end of the protruding connector of FIG. 6 as viewed from beneath the lighting fixture.
Figure 8:
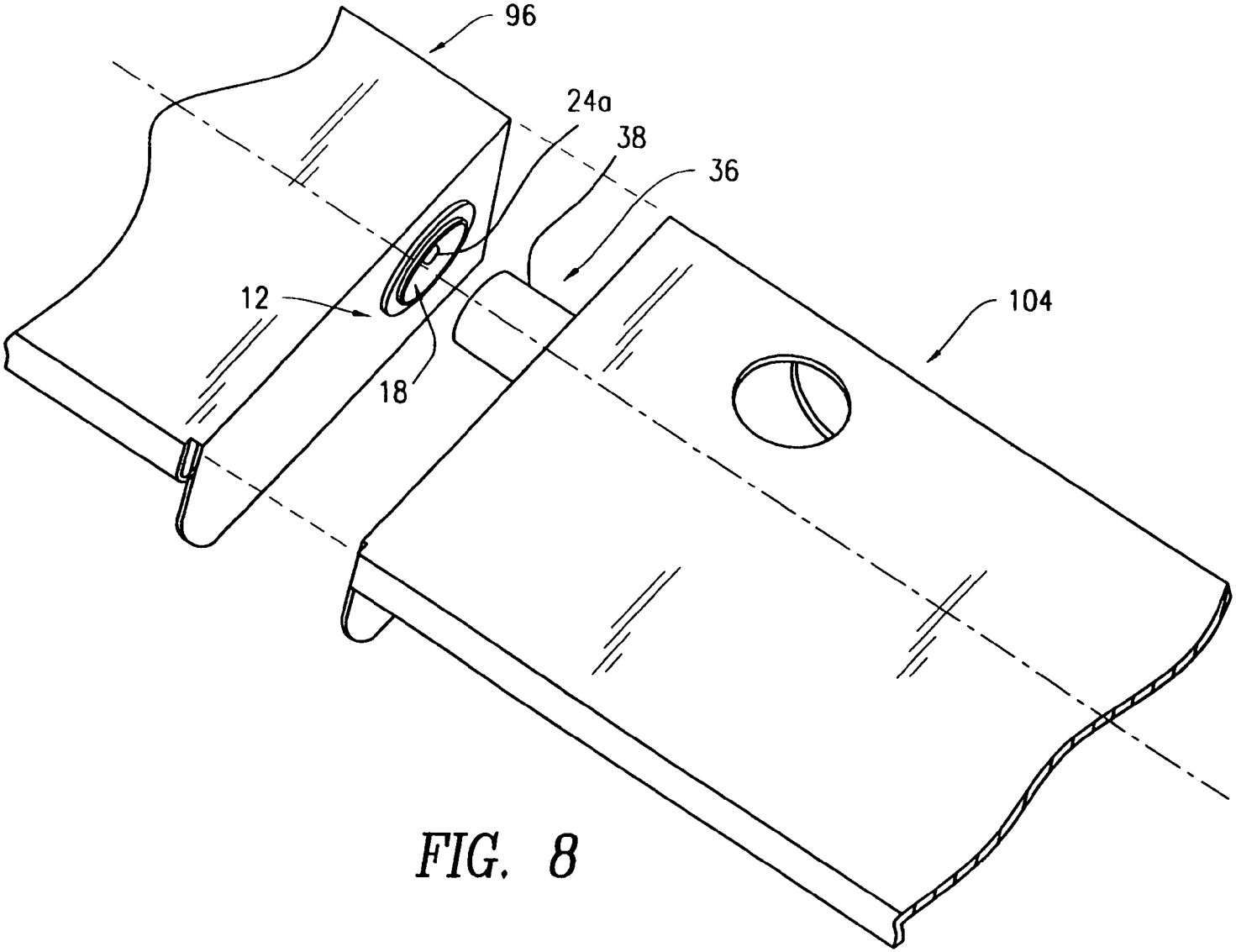
FIG. 8 is a top perspective view of the mated electrical connector pair of FIG. 1 as installed in two lighting fixtures with the recessed and protruding connectors separated from each other.

In preferred embodiments of the present invention, distal ends 88*a*,88*b*,88*c* of male terminals 24*a*,24*b*,24*c* and distal ends 92*a*,92*b*,92*c* of female terminals 46*a*,46*b*,46*c* are configured to provide electrical connections to electrical wiring used in modular lighting fixtures. In the preferred embodiment illustrated herein, distal ends 88*a*,88*b*,88*c*,92*a*,92*b*,92*c* are configured as flat blades (FIGS. 5 and 7). In other embodiments, they may have any configuration suitable for attachment to electrically-powered devices or to power supply adapters for such devices. For example, distal ends 88*a*,88*b*,88*c*,92*a*,92*b*,92*c* may be configured as the male or female members of any known type of mated electrical terminal pairs. They may also be configured to receive a wire end or to facilitate formation of a soldered connection. It is not necessary to the invention that the distal ends 88*a*,88*b*,88*c*,92*a*,92*b*,92*c* of the terminals 24*a*,24*b*,24*c*,46*a*,46*b*,46*c* project beyond the respective webs 22,44, but they must be accessible to provide electrical connections thereto when recessed connector 12 and protruding connector 36 are joined as described herein.

Figure 9:
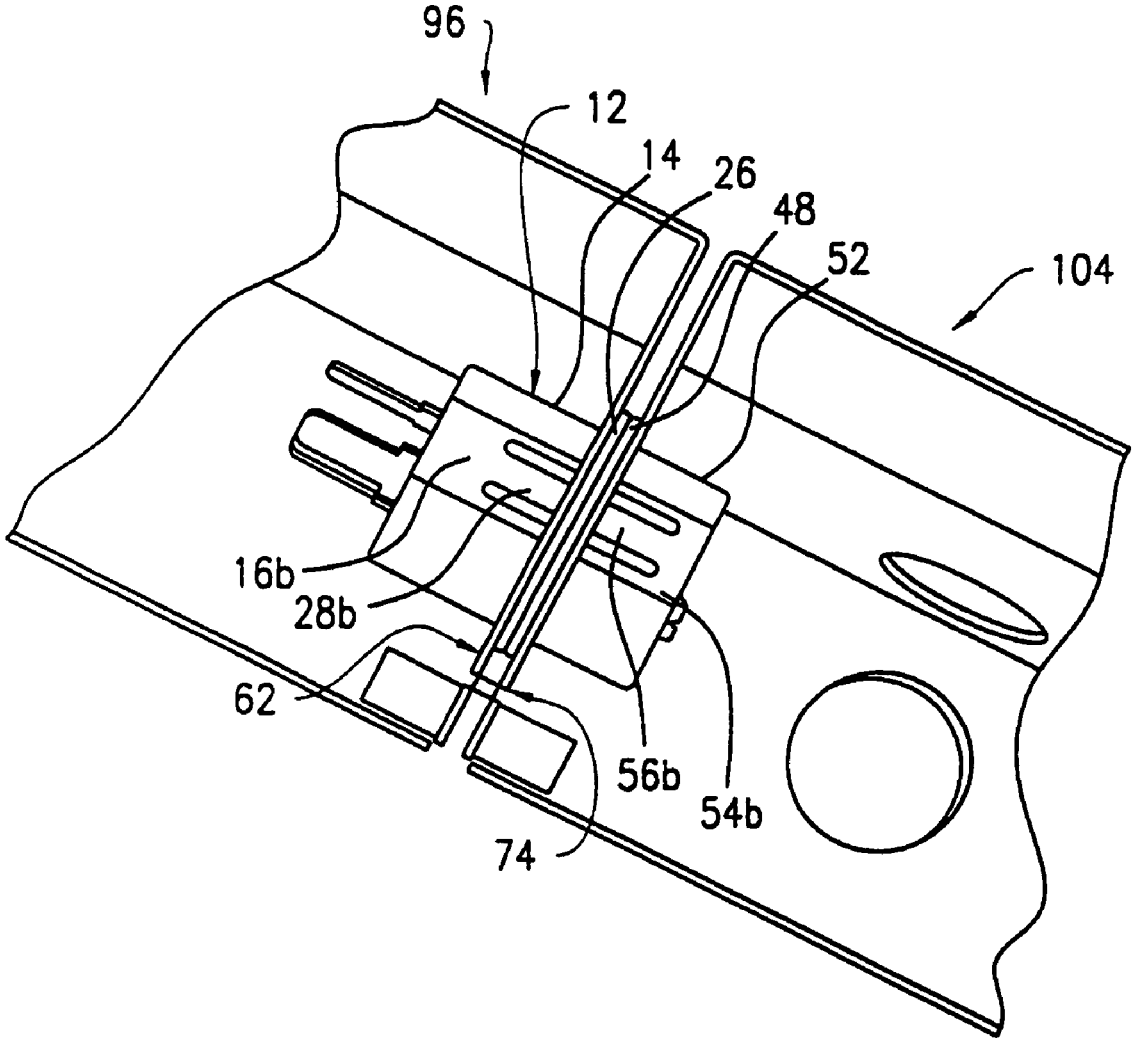
FIG. 9 is a bottom perspective view of the mated electrical connector pair of FIG. 1 as installed in two lighting fixtures with the recessed and protruding connectors joined to each other.

Referring to FIGS. 4–9, connectors 12,36 may be used to connect a plurality of lighting fixtures in an end-to-end arrangement. The lighting fixtures 96,104 are formed from sheet metal that is bent to form a top panel 98,106, a rear panel 100,108 and opposing end panels 62,74. A number of removable knock-outs are provided at selected locations on the panels, each knock-out being removable to create an opening as desired. Connectors 12,36 preferably are installed in end panels 62,74 of the respective fixtures 96,104 so that connectors 12,36 on adjacent end panels 62,74 may be aligned with each other by aligning the end panels 62,74 (FIG. 8), then electrically joined by moving the fixtures 96,104 toward each other (FIG. 9). More preferably, recessed connector 12 is installed in one end panel and protruding connector 36 is installed in the opposing end panel, allowing the fixtures to be electrically connected in an end-to-end arrangement.

The configurations of recessed connector 12 and protruding connector 36 allow adjacent fixtures to be electrically connected to each other in a rapid and convenient manner, even under conditions where the proximal ends of the connectors cannot be observed. In an anticipated method of installation, the connectors 12,36 become aligned with each other when end panel 62 of fixture 96 and end panel 74 of fixture 104 are aligned with each other. Insertion of plug 38 into socket 18 guides openings 94*a*,94*b*,94*c* over the proximal ends 86*a*,86*b*,86*c* of the male terminals. As discussed above, male terminals 24*a*,24*b*,24*c* are properly oriented to make contact with female terminals 46*a*,46*b*,46*c* by the installation of the non-circular distal ends 43,53 of connectors 12,36 into complementary non-circular panel openings 64,76. If one connector is accidentally installed upside-down in its panel, the male terminals 24*a*,24*b*,24*c* will contact end plate 42 between openings 94*a*,94*b*,94*c*, and no electrical connection will be made.

Although the invention disclosed herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the invention.

The invention claimed is:

1. A panel-mounted electrical connector pair (12,36) having a recessed connector (12) with a housing body (14), said housing body (14) having a socket portion (18) with a first flange (26) proximate an open end (20) thereof, a first distal web (22) and at least one first type of electrical terminal (24*a*) protruding through said first distal web (22), one end (86*a*) of said at least one first type electrical terminal (24*a*) extending into said socket portion (18), another end thereof protruding through said distal web (22) in a direction opposite to said socket portion (18), said socket portion (18) extendable through a first opening (64) in a first panel (62), said first flange (26) abutting against a first surface (66) on said first panel (62), said connector pair (12,36) including a protruding connector (36) with a plug portion (38), characterized by:

said protruding connector (36) having a proximal end plate (42), a second distal web (44) spaced from said proximal end plate (42), a side wall (40) extending between said proximal end plate (42) and said second distal web (44), a second flange (48) disposed on said protruding connector (36) proximate to said second distal web (44), and at least one second type of electrical terminal (46*a*) protruding through said second distal web (44) toward said proximal end plate (42), said proximal end plate (42) having at least one opening (94*a*) therein aligned with said at least one second type of electrical terminal (46*a*), said protruding connector (36) extendable through a second opening (76) in a second panel (74), said second flange (48) abutting against a second surface (78) on said second panel (74), said plug portion (38) slideably receivable within said socket portion (18) with said proximal end plate (42) approaching said first distal web (22), said at least one first type electrical terminal (24*a*) penetrating said at least one opening (94*a*) in said end plate (42) and electrically contacting said at least one second type electrical terminal (46*a*) establishing an area of contact located between said first flange (26) and said first distal web (22) when said first panel (62) and said second panel (74) are brought together in close parallel juxtaposition.

2. The connector pair (12,36) of claim 1, further characterized in that said first type of electrical terminal (24*a*) is a male electrical terminal (24*a*) and said second type of electrical terminal (46*a*) is a female electrical terminal (46*a*).

3. The connector pair (12,36) of claim 1, further characterized in that said first flange (26) abuts said second flange (48) when said plug portion (38) is fully inserted into said socket portion (18).

4. The connector pair (12,36) of claim 3, further characterized in that said first flange (26) has a first complementary structure (34) and said second flange (48) has a second complementary structure (50), said first complementary structure (34) and said second complementary structure (50) matingly conjoining together when said first flange (26) abuts against said second flange (48).

5. The connector pair (12,36) of claim 4, further characterized in that said first complementary structure (34) is a ring (34) and said second complementary structure (50) is a groove (50).

6. The connector pair (12,36) of claim 1, further characterized in that at least one of said recessed connector (12) and said protruding connector (36) has a shroud (52) extending therefrom in a direction opposite to the area of contact of said first electrical terminal (24*a*) and said second electrical terminal (46*a*) when said plug portion (38) is received within said socket portion (18).

7. The connector pair (12, 36) of claim 1, further characterized in that said first panel (62) is a panel of a first lighting fixture (96) and said second panel (74) is a panel of a second lighting fixture (104).

8. The connector pair (12, 36) of claim 7, further characterized in that said connector pair (12, 36) connects adjacent lighting fixtures (96, 104).

9. The connector pair (12, 36) of claim 1, further characterized in that said housing body 14 and said shroud 52 are non-circular and fit into mating non-circular panel openings (64, 76), respectively, to provide a pre-selected orientation of said recessed electrical connector (12) and said protruding connector (36) relative to said first panel (62) and said second panel (74), respectively.

10. The connector pair (12, 36) of claim 9, further characterized in that said housing body (14) and said shroud (52) have flats (16*a*, 54*a*), respectively, thereon.

11. The connector pair (12, 36) of claim 10, further characterized in that the preselected orientation of said recessed connector (12) and said protruding connector (36) align, to permit said at least one first type electrical terminal (24*a*) to contact said at least one second type electrical terminal (46*a*) when said first panel (62) and said second panel (74) are brought into close parallel juxtaposition with the plug portion (38) inserting into the socket portion (18).

12. The connector pair (12, 36) of claim 11, further characterized in that said first panel (62) and said second panel (74) are panels of said first light fixture (96) and said second light fixture (104), respectively, mounted upon a surface and electrically connected in an end-to-end configuration.

13. The connector pair (12, 36) of claim 12, further characterized in that said recessed connector (12) has a first retainer (28*a*) and said protruding connector has a second retainer (58*a*), said first panel (62) being captured between said first flange (26) and said first retainer (58*a*) and said second panel (74) being captured between said second flange (48) and said second retainer (58*a*) when said recessed connector (12) and said protruding connector (36) are installed in said first panel (62) and said second panel (74), respectively.

14. The connector pair (12, 36) of claim 13, further characterized in that said recessed connector (12) has a first opposing retainer (28*b*) like said first retainer (28*a*) but disposed opposite thereto on said recessed connector (12) and said protruding connector (36) has a second opposing retainer (56*b*) like said second retainer (56*a*) but disposed opposite thereto on said protruding connector (36).

15. The connector pair (12, 36) of claim 14, further characterized in that each of said first retainer (28*a*), said first opposing retainer (28*b*), said second retainer (56*a*) and said second opposing retainer (56*b*) have a free end (32*a*, 32*b*, 60*a*, 60*b*) and a connected end (58*a*, 58*b*) said first panel (62) and said second panel (74) each being captured between said first flange (26) and said second flange (48), respectively, and, said free ends (32*a*, 32*b*)(60*a*, 60*b*), respectively.

16. The connector pair (12,36) of claim 15, further characterized in that each of said first retainer (28*a*), said first opposing retainer (28*b*), said second retainer (56*a*) and said second opposing retainer (56*b*) diverge outwardly relative to an axis of said recessed connector (12) and said protruding connector (36), respectively, from the connected end (58*a*, 58*b*) to the free end (32*a*,33*b*,60*a*,60*b*) thereof.

17. The connector pair (12,36) of claim 16, further characterized in that each of said first retainer (28*a*), said first opposing retainer (28*b*), said second retainer (56*a*) and said second opposing retainer (56*b*) are each disposed proximate said flats (16*a*, 54*a*).

* * * * *